US012685411B2

(12) United States Patent
Xiao

(10) Patent No.: US 12,685,411 B2
(45) Date of Patent: Jul. 21, 2026

(54) FRAMELESS AND HIDDEN PULLEY BATHROOM DOOR

(71) Applicant: Foshan Lanfeilin Sanitary Ware Co., Ltd., Foshan (CN)

(72) Inventor: Haisheng Xiao, Foshan (CN)

(73) Assignee: Foshan Lanfeilin Sanitary Ware Co., Ltd., Foshan (CN)

( * ) Notice: Subject to any disclaimer, the term of this patent is extended or adjusted under 35 U.S.C. 154(b) by 126 days.

(21) Appl. No.: 18/911,631

(22) Filed: Oct. 10, 2024

(65) Prior Publication Data

US 2026/0102030 A1 Apr. 16, 2026

(51) Int. Cl.
*A47K 3/34* (2006.01)
*A47K 3/30* (2006.01)

(52) U.S. Cl.
CPC ..... *A47K 3/34* (2013.01); *A47K 3/302* (2013.01)

(58) Field of Classification Search
CPC . A47K 3/34; A47K 3/022; A47K 3/00; A47K 3/28; A47K 3/08; A47K 3/14; A47K 3/302; A47K 3/362; A47K 3/281; A47G 1/653; A47G 1/24
USPC ..... 4/607, 605, 557
See application file for complete search history.

(56) References Cited

U.S. PATENT DOCUMENTS 5,657,581 A * 8/1997 Husting ..... A47K 3/34 49/411
5,852,837 A * 12/1998 Husting ..... A47K 3/34 4/607
6,860,078 B1 * 3/2005 Geisthardt ..... E06B 3/5892 52/745.16
7,765,740 B2 * 8/2010 Heuel ..... B60J 5/062 49/248
7,930,856 B2 * 4/2011 Hooper, Jr. ..... E05D 15/066 49/411
11,708,719 B1 * 7/2023 Woods ..... E04H 1/1266 160/121.1
2003/0019030 A1 * 1/2003 Kopacz ..... E05D 7/081 4/607
2009/0241428 A1 * 10/2009 Hooper, Jr. ..... E06B 7/14 49/404
2018/0252024 A1 * 9/2018 Xie ..... E06B 3/92

FOREIGN PATENT DOCUMENTS

CA 3123143 A1 * 11/2021 ..... E06B 3/4681
CN 1075622 A * 9/1993 ..... A47K 3/34
CN 1128491 A * 8/1996 ..... E06B 3/5072
(Continued)

*Primary Examiner* — Lori L Baker
(74) *Attorney, Agent, or Firm* — Birchwood IP

(57) ABSTRACT

A pulley bathroom door includes a fixed rail and a sliding door installed at a bottom of the fixed rail. The sliding door includes a fan body and a pulley rotatably connected to the fan body. The pulley is installed on one side of a top of the fan body, and the fixed rail includes a rail body. The rail body includes a bottom plate, side plates provided on two sides of the bottom plate, and guide rails installed on the side plates. The bottom plate and two side plates form a chamber with an opening that accommodates the fan body and the pulley. The guide rail is configured to be installed on inner sides of the side plates, and the pulley cooperates with the guide rail. The pulley bathroom door can avoid the pulley from being exposed.

9 Claims, 10 Drawing Sheets

(56) References Cited

FOREIGN PATENT DOCUMENTS

| | | | | | |
|---|---|---|---|---|---|
| CN | 1547444 | A | * | 11/2004 | E05D 7/04 |
| CN | 202970311 | U | * | 6/2013 | E05D 13/00 |
| CN | 104047526 | A | * | 9/2014 | A47K 3/34 |
| CN | 205713698 | U | * | 11/2016 | A47K 3/34 |
| CN | 108324155 | A | * | 7/2018 | A47K 3/34 |
| CN | 110199077 | A | * | 9/2019 | A47K 3/34 |
| CN | 110584520 | A | * | 12/2019 | A47K 3/34 |
| CN | 111550159 | A | * | 8/2020 | E06B 3/4636 |
| CN | 111691792 | A | * | 9/2020 | E05F 5/003 |
| CN | 112313390 | A | * | 2/2021 | E05D 13/00 |
| CN | 113622775 | A | * | 11/2021 | E05D 15/0626 |
| CN | 113969716 | A | * | 1/2022 | E05F 5/003 |
| CN | 114176438 | A | * | 3/2022 | E04H 1/125 |
| CN | 114776162 | A | * | 7/2022 | E05D 13/00 |
| CN | 115075699 | A | * | 9/2022 | E06B 7/22 |
| CN | 118208134 | A | * | 6/2024 | A47K 3/34 |
| CN | 223215139 | U | * | 8/2025 | A47K 3/34 |
| CN | 223262817 | U | * | 8/2025 | A47K 3/34 |
| DE | 102023125856 | A1 | * | 9/2024 | E05D 15/1047 |
| JP | H05195668 | A | * | 8/1993 | A47K 3/34 |
| JP | H09119152 | A | * | 5/1997 | A47K 3/34 |
| JP | H11141235 | A | * | 5/1999 | A47K 3/34 |
| JP | 2003343166 | A | * | 12/2003 | A47K 3/34 |
| JP | 2005036571 | A | * | 2/2005 | A47K 3/34 |
| JP | 2005098001 | A | * | 4/2005 | A47K 3/34 |
| JP | 2007138390 | A | * | 6/2007 | A47K 3/34 |
| JP | 4329751 | B2 | * | 9/2009 | A47K 3/34 |
| JP | 2010077673 | A | * | 4/2010 | A47K 3/34 |
| JP | 3215460 | U | * | 3/2018 | A47K 3/34 |
| JP | 2018178515 | A | * | 11/2018 | A47K 3/34 |
| JP | 2020110348 | A | * | 7/2020 | A47K 3/34 |
| JP | 7334650 | B2 | * | 8/2023 | A47K 3/34 |
| KR | 101515539 | B1 | * | 5/2015 | E05D 15/0634 |
| KR | 101749594 | B1 | * | 6/2017 | E05F 17/004 |
| KR | 20180133666 | A | * | 12/2018 | E05D 15/0669 |
| WO | WO-2008155030 | A2 | * | 12/2008 | A47K 3/34 |
| WO | WO-2009000548 | A2 | * | 12/2008 | B60J 5/062 |
| WO | WO-2016206607 | A1 | * | 12/2016 | E06B 1/52 |

* cited by examiner

FRAMELESS AND HIDDEN PULLEY BATHROOM DOOR

TECHNICAL FIELD

The present application relates to the field of bathroom door technologies, and in particular, to a frameless and hidden pulley bathroom door.

BACKGROUND

Usually, bathroom doors are available in two types: rotating swing type or push-pull and slidable type. Slidable type bathroom doors are usually equipped with a straight partition, and a track is installed at the partition. One or more sliding doors that can slide along the track are suspended below the track.

The current push-pull and sliding door is equipped with a track above the door opening, and the sliding door is suspended from a lower part of the track through pulleys. For stability and balance, pulleys are usually installed on two sides of a movable glass door panel. Correspondingly, the track consists of two slides, with a pulley groove on each side of the slide. A pulley set is installed in the pulley groove, and a hanging clamp is installed below the pulley set to clamp the movable glass door panel. However, due to a limitation of the opening of the movable glass door panel and a size of the track, the hanging clip under the pulley groove will be exposed on the track, which affects an aesthetics of the product. In the existing technology, if the hanging clip needs to be hidden, the track must be enlarged and raised, which also affects the aesthetics of the product and wastes materials. In addition, this type of sliding door will also have side borders on both sides of the door opening. The providing of the side borders will occupy the space of the passage after the sliding door is opened, and the existence of side borders will affect the visual effect, which does not meet the modern people's pursuit of minimalist style without borders.

The technical problem to be solved by the present application is that how to solve a problem of exposed pulleys and side borders in existing slidable bathroom doors, which affect product aesthetics and lead to waste of raw materials.

SUMMARY

In order to overcome the shortcomings of existing technology, the purpose of the present application is to provide a frameless and hidden pulley bathroom door, which has characteristics of simple structure, minimalist and beautiful appearance.

The technical solution adopted by the present application is that a frameless hidden pulley bathroom door, including a fixed rail and a sliding door provided at a bottom of the fixed rail, where the sliding door includes a fan body and a pulley rotatably connected to the fan body, the pulley is provided on one side of a top of the fan body, the fixed rail includes a rail body; the rail body includes a bottom plate, side plates provided on two sides of the bottom plate, and guide rails provided on the side plates; the bottom plate and two side plates form a chamber with an opening that accommodates the fan body and the pulley; the guide rail is provided on inner sides of the side plates, and the pulley is slid and cooperated with the guide rail.

In some embodiments, the sliding door further includes an installation seat configured to install the pulley, the installation seat includes a fixed disk and an eccentric seat, the fixed disk and the pulley are respectively provided on opposite sides of the fan body, the eccentric seat is fixedly provided on one side of the fixed disk near the pulley, and the eccentric seat is eccentrically provided with the fixed disk, the fan body is provided with an installation groove for the eccentric seat to pass through, the pulley includes a wheel body and a rotation shaft, the rotation shaft is fixedly connected to the eccentric seat, and the wheel body is rotatably connected to the rotation shaft.

In some embodiments, the installation seat further includes a shaft sleeve sleeved on an outer surface of the eccentric seat.

In some embodiment, the fixed disk is provided with an adjustment groove configured to adjust an angle of the eccentric seat.

In some embodiments, the installation seat further includes a first protective cover and a second protective cover, the first protective cover includes a first cover body and a first extension rod, the first cover body is covered with the fixed disk; one end of the first extension rod is connected to the first cover body, and the other end thereof is extended over a top of the fan body and towards the pulley; the second protective cover includes a second cover body and a second extension rod, the second cover body is provided between the fan body and the wheel body, and the second cover body is provided with a through hole configured for the rotation shaft to pass through; one end of the second extension rod is connected to the second cover body, and the other end thereof is extended over the top of the fan body and towards the first cover body.

In some embodiments, the fixed rail further includes fixed seats provided at two ends of the rail body, each of the fixed seats includes a seat body and a cover plate detachably connected to the seat body, the seat body is provided with a slot configured for the rail body to be inserted, a top of the slot is provided with an opening, and the cover plate is provided with an opening.

In some embodiments, the fixed rail further includes a guide clip embedded in the seat body, and the guide clip is provided with a guide groove corresponding to the fan body.

In some embodiments, the fixed rail further includes a buffering member provided in the guide groove.

In some embodiments, the sliding door further includes waterproof strips, which are provided on opposite sides of the fan body.

In some embodiments, the frameless and hidden pulley bathroom door further includes a lower fixed seat and a water blocking member that are provided at a bottom of the sliding door, where the lower fixed seat is provided with a sliding groove corresponding to the fan body, and the water blocking member is provided on one side of the fan body so as to prevent water from spreading from a bottom of the fan body.

The beneficial effects of the present application are: the frameless and hidden pulley bathroom door of the present application, by directly providing the pulley on the fan body and providing the guide rail on the inner side of the rail body, which can avoid the pulley from being exposed, rendering it more beautiful, and there is no need to equip a pulley frame and a hanging clip as traditional sliding doors, a distance between the pulley and the top of the fan body can be minimized, which is beneficial for reducing an overall thickness of the rail body and rendering the structure simpler and more compact. Furthermore, the side frame provided with traditional sliding door openings is eliminated, which not only saves material costs but also enhances the beauty of the product, in line with consumers' pursuit of minimalist frameless style.

DESCRIPTION OF EMBODIMENTS

Figure 1:
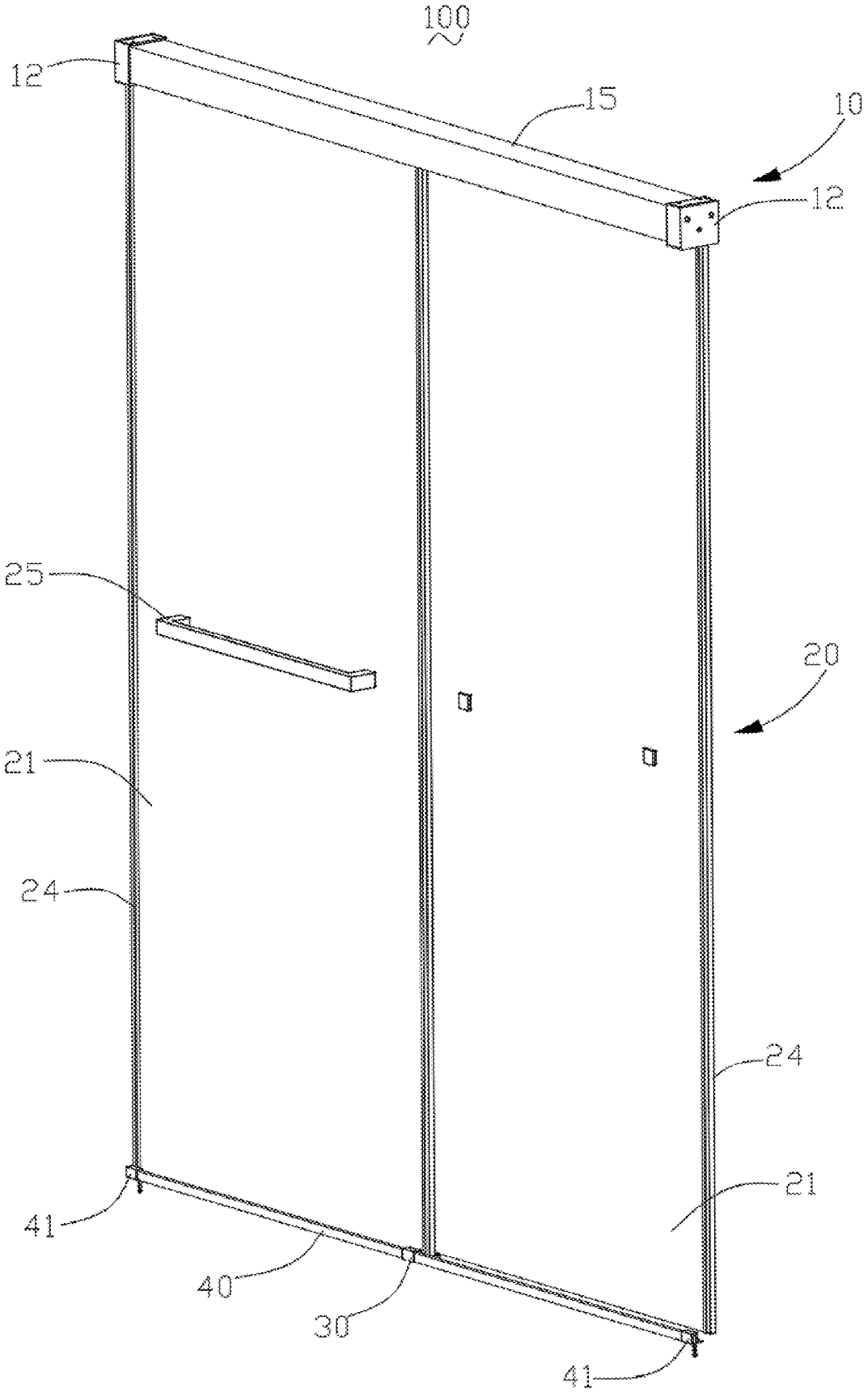
FIG. 1 is a schematic structural diagram of a frameless and hidden pulley bathroom door in an embodiment of the present application.

The following will provide a clear and complete description of the technical solution in the embodiments of the present application, based on the accompanying drawings. Obviously, the described embodiments are only a part of the embodiments of the present application, not all of them. Based on the embodiments in the present application, all other embodiments obtained by those skilled in the art without creative work are within the protection scope of the present application.

It should be noted that when a component is referred to as "fixed to" another component, it can be directly on the other component or there can also be an intermediate component. When a component is considered to be "connected" to another component, it can be directly connected to another component or there may be an intermediate component present at the same time. When the number of components is referred to "a plurality of", it can be any number of two or more. Terms "vertical", "horizontal", "left", "right" and similar expressions used in this specification are for an illustrative purpose only and do not represent the implementation mode.

Unless otherwise defined, all technical and scientific terms used in this specification have the same meanings as those commonly understood by those skilled in the art belonging to the present application. Terms used in the specification of the present application are only for a purpose of describing specific embodiments and are not intended to limit the present application. Term "and/or" used in this specification includes any and all combinations of one or more related listed items.

Embodiment 1

Please refer to FIGS. 1 to 8, which is a frameless and hidden pulley bathroom door 100 according to an embodiment of the present application. The door includes a fixed rail 10 and a sliding door 20 provided at a bottom of the fixed rail 10. The sliding door 20 includes a fan body 21 and a pulley 22 rotatably connected to the fan body 21. The pulley 22 is provided on one side of a top of the fan body 21. The fixed rail 10 includes a rail body 11, which includes a bottom plate 111, side plates 112 provided on two sides of the bottom plate 111, and guide rails 113 provided on the side plates 112. The bottom plate 111 and two side plates 112 form a chamber with an opening that accommodates the fan body 21 and the pulley 22. The guide rail 113 is provided on inner sides of the side plates 112, and the pulley 22 is slid and cooperated with the guide rail 113. The frameless and hidden pulley bathroom door 100 of the present application can avoid the pulley 22 from being exposed and is more aesthetically pleasing by directly providing the pulley 22 on the fan body 21 and providing the guide rail 113 on the inner sides of the rail body 11. Thus, there is no need to provide a pulley frame and a hanging clip as the traditional sliding door 20. A distance between the pulley 22 and a top of the fan body 21 can be minimized, which is conducive to reducing an overall thickness of the rail body 11 and rending the structure simpler and more compact. In an implementation mode, a side frame provided by a door opening of the traditional sliding door 20 is eliminated, which not only saves material costs but also enhances the beauty of the product, in line with consumers' pursuit of a minimalist frameless style.

It should be noted that the number of sliding doors 20 can be increased or decreased according to needs. When there is one sliding door 20, a part of the fixed rail 10 is embedded into a wall. When the door is opened, the sliding door 20 is stored in the wall. When there are two sliding doors 20, the two sliding doors 20 are arranged in parallel, and guide rails 113 are respectively provided on two side plates 112. When there are more than two sliding doors 20, the sliding doors 20 are arranged in parallel. A corresponding middle plate can be provided between two side plates 112, and a guide rail 113 can be provided on the middle plate to achieve an installation of a plurality of sliding doors 20 on the fixed rail 10 without interference, and some sliding doors 20 can also share the same guide rail 113. In addition, the pulleys 22 provided on each fan body 21 can be increased or decreased according to an actual need, and are not limited to those shown in the attached drawings. Generally, in order to improve a stability of the sliding of the fan body 21, in an implementation mode, there are two or more pulleys 22 on each fan body 21.

In an implementation mode, when there are more than one fan body 21, a part of the fan body 21 can be fixed and only serve as partition, while another part of the fan body 21 can be slid relative to a fixed part of the fan body 21 so as to close or open a passage.

The following provides a detailed introduction to the technical solution of the present application when taking two sliding doors 20 as an example.

In this embodiment, there are two sliding doors 20, and the two side plates 112 are respectively provided with a guide rail 113. The pulleys 22 on the two sliding doors 20 are provided to be away.

Figure 2:
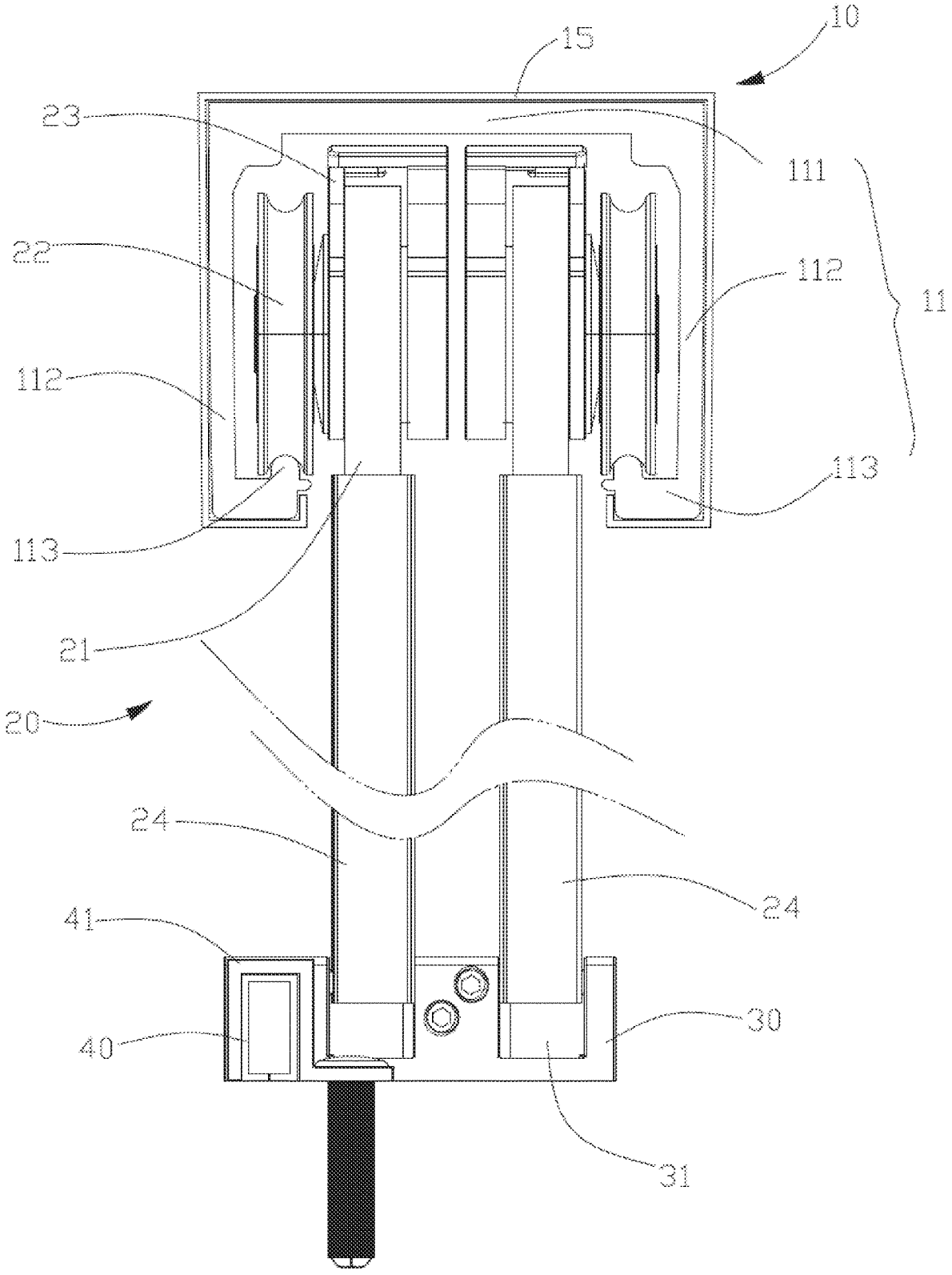
FIG. 2 is a side schematic structural diagram of the frameless and hidden pulley bathroom door shown in FIG. 1.
Figure 6:
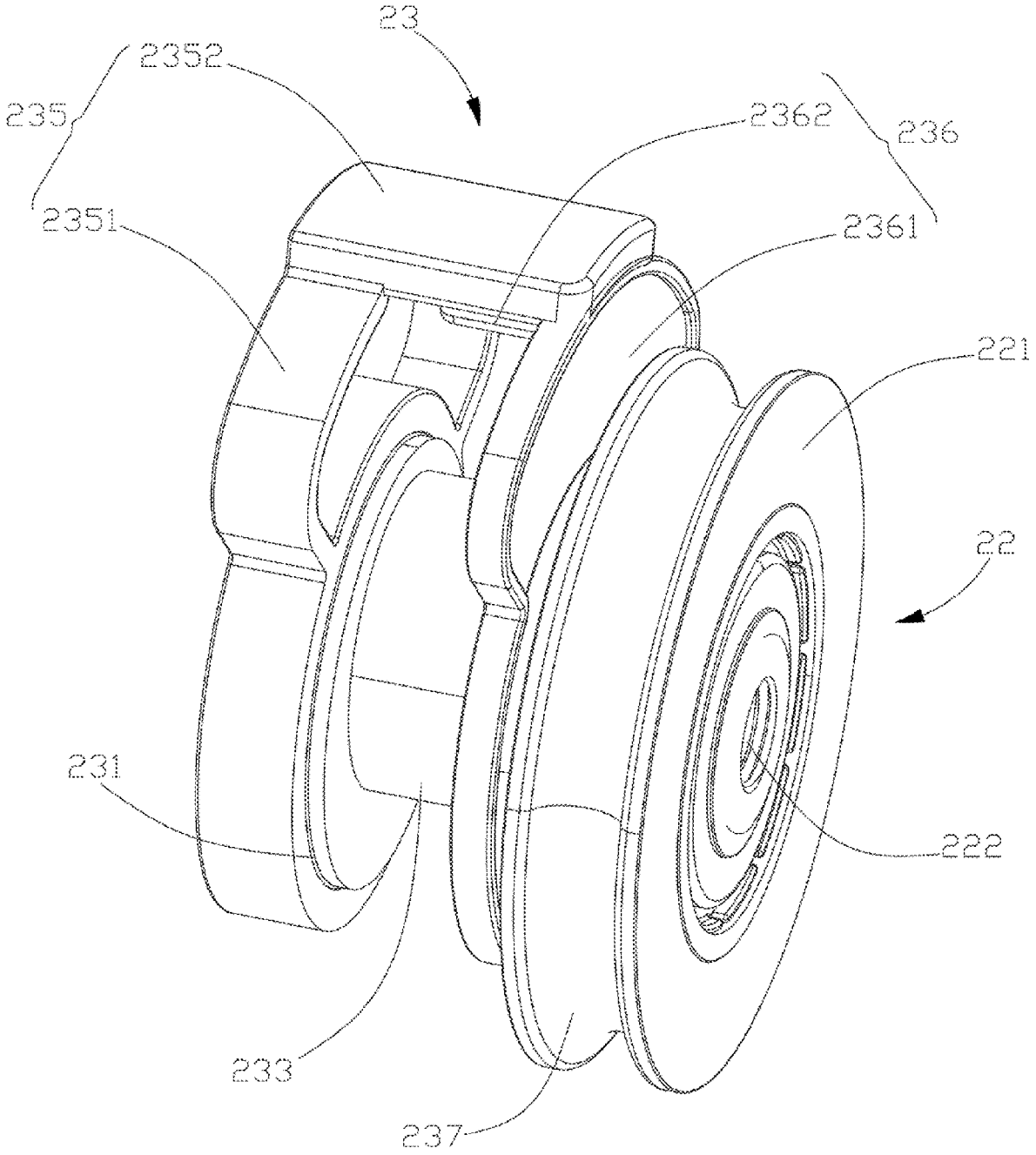
FIG. 6 is a schematic structural diagram of a pulley and an installation seat shown in FIG. 2.
Figure 7:
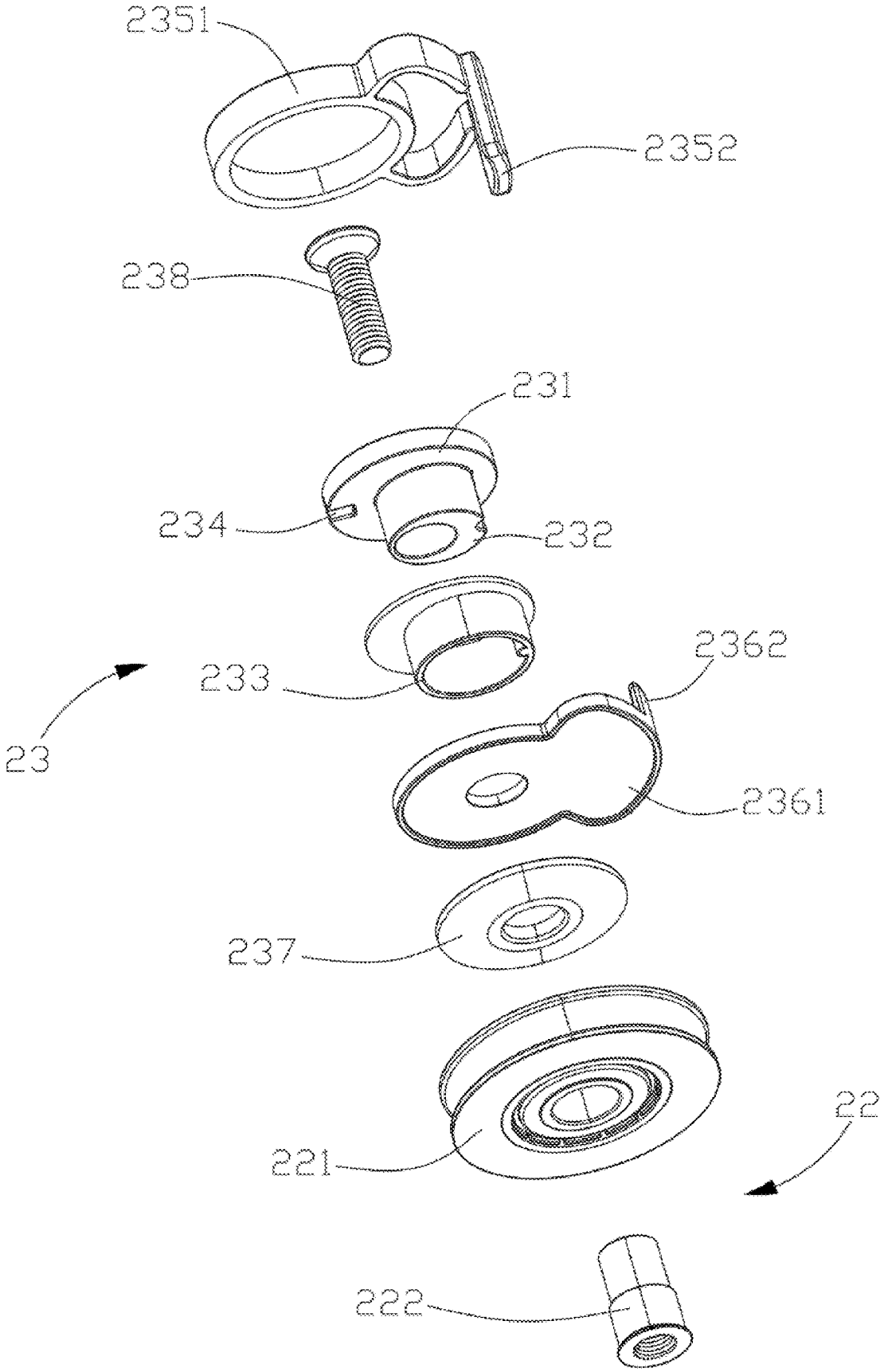
FIG. 7 is an exploded structural schematic diagram of the pulley and the installation seat shown in FIG. 6.

As shown in FIGS. 2 and 6, the sliding door 20 further includes an installation seat 23 configured to install the pulley 22. The installation seat 23 includes a fixed disk 231 and an eccentric seat 232. The fixed disk 231 and the pulley 22 are respectively provided on opposite sides of the fan body 21. The eccentric seat 232 is fixed on one side of the fixed disk 231 near the pulley 22, and the eccentric seat 232 is eccentrically arranged with the fixed disk 231. The fan body 21 is provided with an installation groove configured for the eccentric seat 232 to pass through. The pulley 22 includes a wheel body 221 and a rotation shaft 222. The rotation shaft 222 is fixedly connected to the eccentric seat 232, and the wheel body 221 is rotatably connected to the rotation shaft 222. By providing the eccentric seat 232 on the installation seat 23, the eccentric seat 232 can be driven to rotate by rotating the installation seat 23, thereby adjusting a height of the pulley 22 for easy fine-tuning during installation and debugging.

In an implementation mode, in order to facilitate an adjustment of the height of the pulley 22, an adjustment groove 234 is provided on the fixed disk 231 for adjusting an angle of the eccentric seat 232.

In an implementation mode, in order to protect the installation groove provided on the fan body 21 and reduce wear, the installation seat 23 further includes a shaft sleeve 233 sleeved on an outer surface of the eccentric seat 232. In an implementation mode, in order to prevent a relative rotation between the shaft sleeve 233 and the eccentric seat 232, a limit groove is provided on the eccentric seat 232, and a corresponding limit block is provided on an inner hole of the shaft sleeve 233. By matching the limit block with the limit groove, the shaft sleeve 233 and the eccentric seat 232 can rotate synchronously.

In an implementation mode, the installation seat 23 further includes a first protective cover 235 and a second protective cover 236. The first protective cover 235 includes a first cover 2351 and a first extension rod 2352. The first cover 2351 is covered with the fixed disk 231; one end of the first extension rod 2352 is connected to the first cover 2351, and the other end thereof is extended over a top of the fan body 21 and towards the pulley 22. The second protective cover 236 includes a second cover 2361 and a second extension rod 2362, the second cover 2361 is provided between the fan body 21 and the wheel body 221. The second cover 2361 is provided with a through hole for the rotation shaft 222 to pass through. One end of the second extension rod 2362 is connected to the second cover 2361, and the other end thereof is extended over the top of the fan body 21 and towards the first cover 2351. The fixed disk 231 and the rotation shaft 222 are connected by a screw 238. In order to ensure strength, the fixed disk 231 and the eccentric seat 232 are usually made of metal material that is integrally formed. However, the bathroom is an environment with high humidity. The first cover 2351 is provided with the fixed disk 231 so as to protect the fixed disk 231 and the screw 238 from corrosion caused by water vapor invasion. The second cover 2361 can protect one end of the eccentric seat 232 away from the fixed disk 231, which can prevent corrosion of the eccentric seat 232. The first extension rod 2352 and the second extension rod 2362 can protect the top of the fan body 21, avoiding a collision of the top of the fan body 21 by the bottom plate 111.

In an implementation mode, in order to reduce a pressure exerted on the fan body 21 by the rotation shaft 222 and the screw 238, a gasket 237 is further provided between the second protective cover 236 and the wheel body 221.

Figure 4:
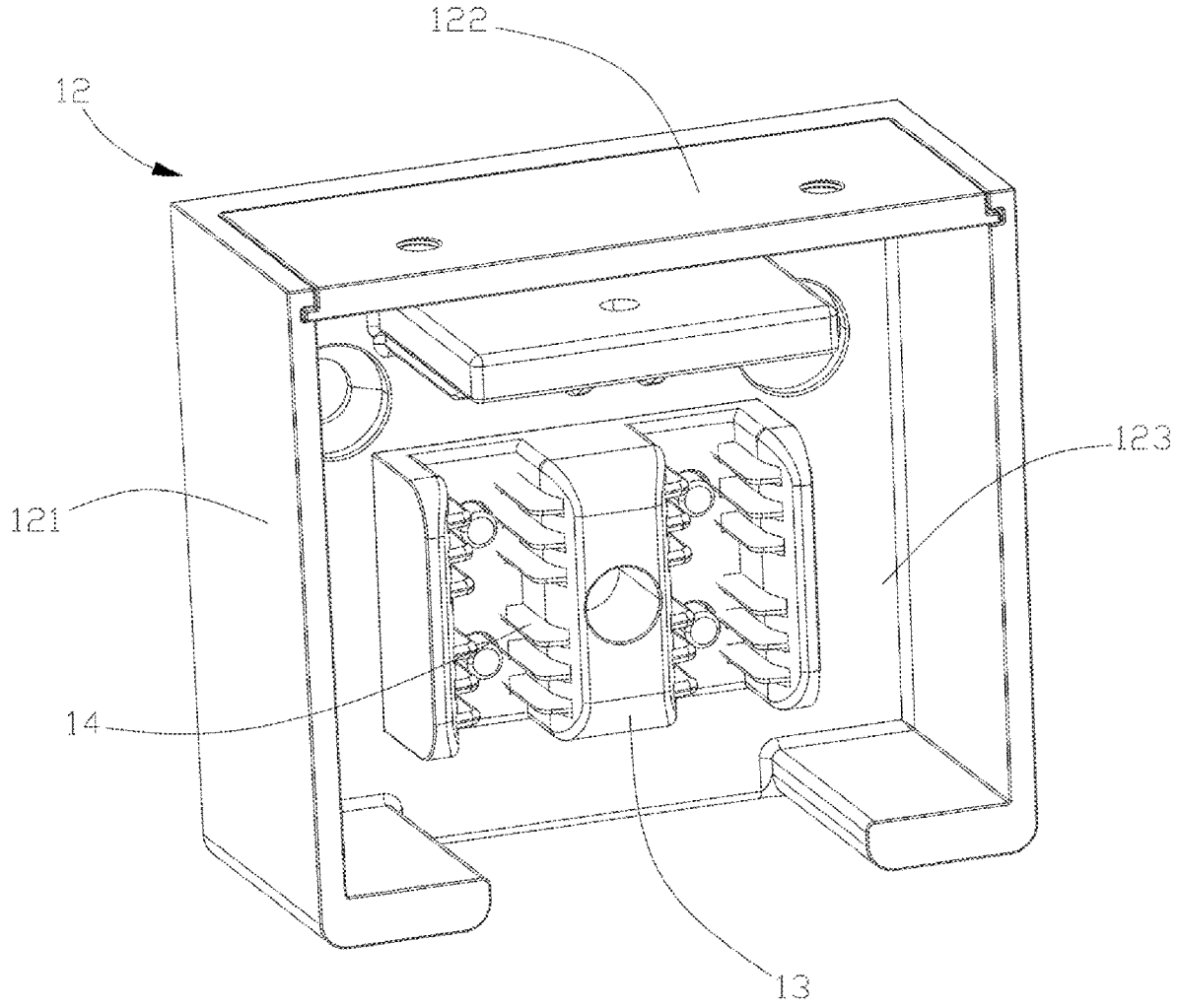
FIG. 4 is a schematic structural diagram of a fixed seat, a guide clip, and a buffering member in the fixed rail shown in FIG. 3.

As shown in FIGS. 1 and 4, in order to facilitate a fixation of the rail body 11 on the wall, the fixed rail 10 further includes fixed seats 12 provided at two ends of the rail body 11. Each of the fixed seats 12 includes a seat body 121 and a cover plate 122 that can be detachably connected to the seat body 121. The seat body 121 is fixed to the wall by means of an expansion screw 238 and other means. The seat body 121 is provided with a slot 123 configured for the rail body 11 to be inserted, and a top of the slot 123 is provided with an opening. The cover plate 122 is covered with an opening. The cover plate 122 is opened to allow the two ends of the rail body 11 to be inserted into the slot 123, and then the cover plate 122 is covered to fix the rail body 11 on the fixed seat 12. In an implementation mode, there is a clamp slot 33 on the seat body 121 that corresponds to the cover plate 122, rendering it easy to install and remove the cover plate 122. In order to prevent the cover plate 122 from easily falling off, a screw is further provided on the cover plate 122, which can be screwed into the cover plate 122 and abutted against the bottom plate 111 so as to lock the cover plate 122.

In an implementation mode, the slot 123 is further provided with a first support block 124 for supporting the bottom plate 111 and a second support block 125 for supporting the side plates 112. By providing the first support block 124 and the second support block 125, a support force of the seat body 121 supporting the rail body 11 can be increased, and a load-bearing capacity of the fixed rail 10 can be improved.

Figure 5:
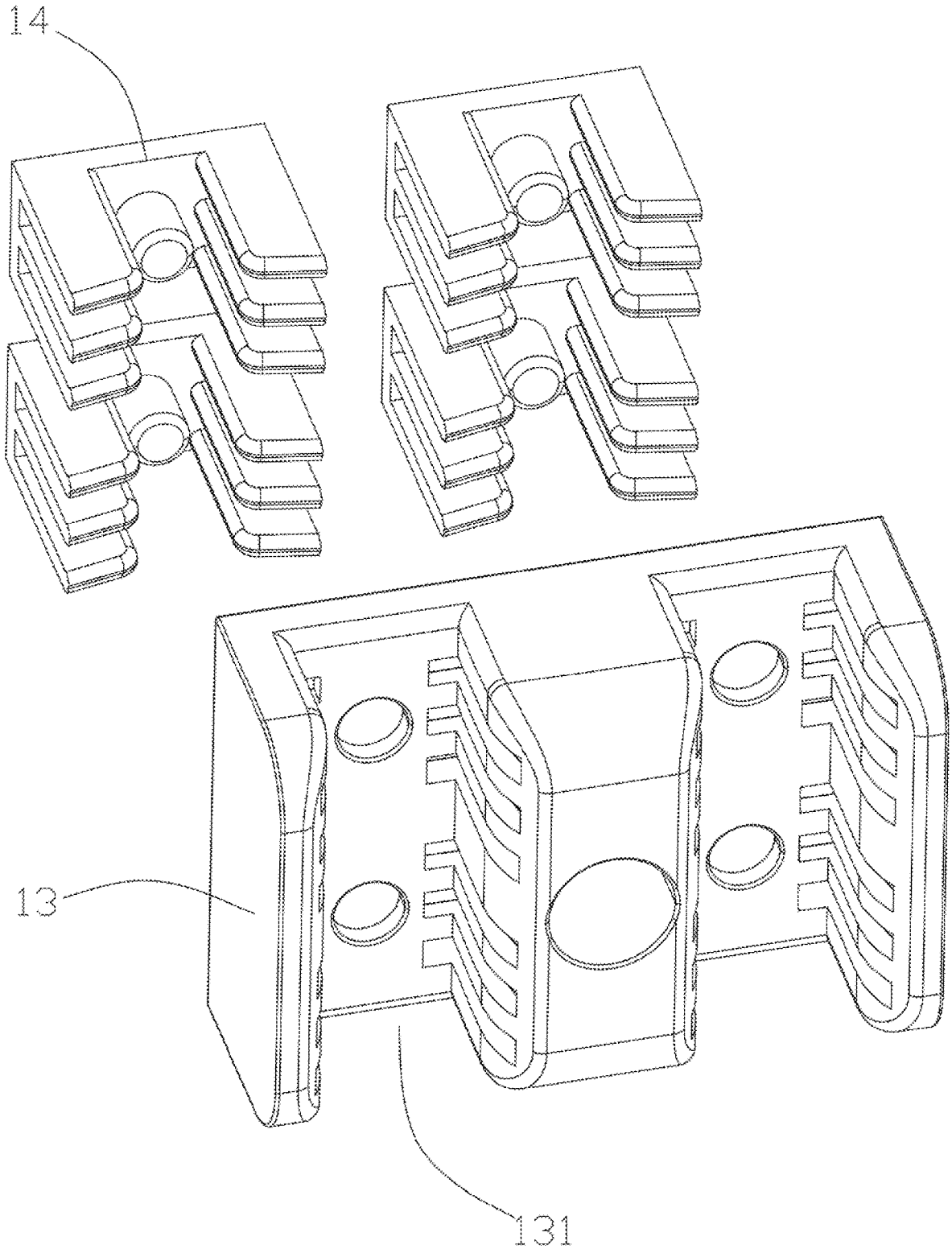
FIG. 5 is an exploded schematic structural diagram of the guide clip and the buffering member shown in FIG. 4.

As shown in FIGS. 4 and 5, the fixed rail 10 further includes a guide clip 13 embedded in the seat body 121. The guide clip 13 is provided with a guide groove 131 corresponding to the fan body 21, and the number of the guide groove 131 corresponds one-to-one with the number of fan bodies 21. The guide clip 13 can limit the fan body 21 when it is slid into the fixed seat 12, thereby avoiding the fan body 21 from shaking and improving the safety.

In an implementation mode, the fixed rail 10 further includes a buffering member 14, which is provided in the guide groove 131. The buffering member 14 can increase the buffering for the fan body 21 to slide into the guide groove 131, reducing noise and protecting the fan body 21 from intense impacts. In an implementation mode, the buffering member 14 is made of elastic materials such as silicone, rubber, etc.

In this embodiment, the buffering member 14 is provided with a plurality of rib shaped and columnar protrusions, the rib shaped protrusions are provided at a side wall of the guide groove 131 and the columnar protrusions are provided at a bottom of the guide groove 131.

In an implementation mode, the sliding door 20 further includes waterproof strips 24, which are provided on opposite sides of the fan body 21. The waterproof strips 24 can improve waterproof performance, prevent water from seeping out from the door seams during bathing, and also protect a side edge of the fan body 21 from being damaged by collisions. In order to improve the waterproof and buffering effects, the waterproof strips 24 should have elasticity.

In an implementation mode, in order to facilitate the opening and closing of the sliding door 20, a handle 25 is further provided on the fan body 21.

Figure 3:
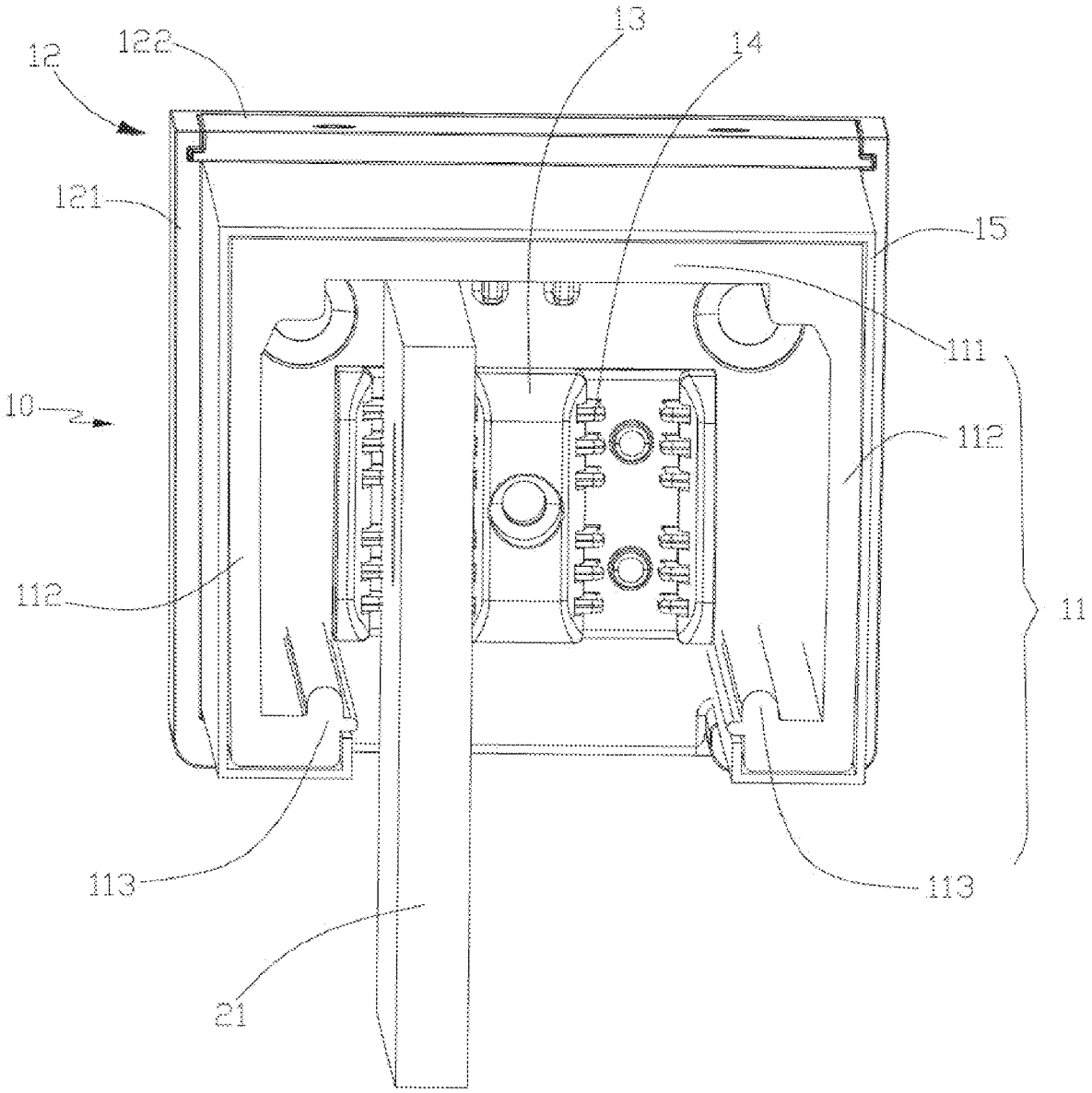
FIG. 3 is a schematic structural diagram of a fixed rail and a sliding door in the frameless and hidden pulley bathroom door shown in FIG. 1.

As shown in FIGS. 1 to 3, in order to enhance appearance and texture of the frameless and hidden pulley bathroom door 100, a frame 15 is further wrapped around an outer side of the rail body 11. Because the rail body 11 is usually made of aluminum alloy material, which lacks brightness, wrapping a layer of stainless steel or composite material frame 15 on its surface can improve the appearance and texture.

Figure 8:
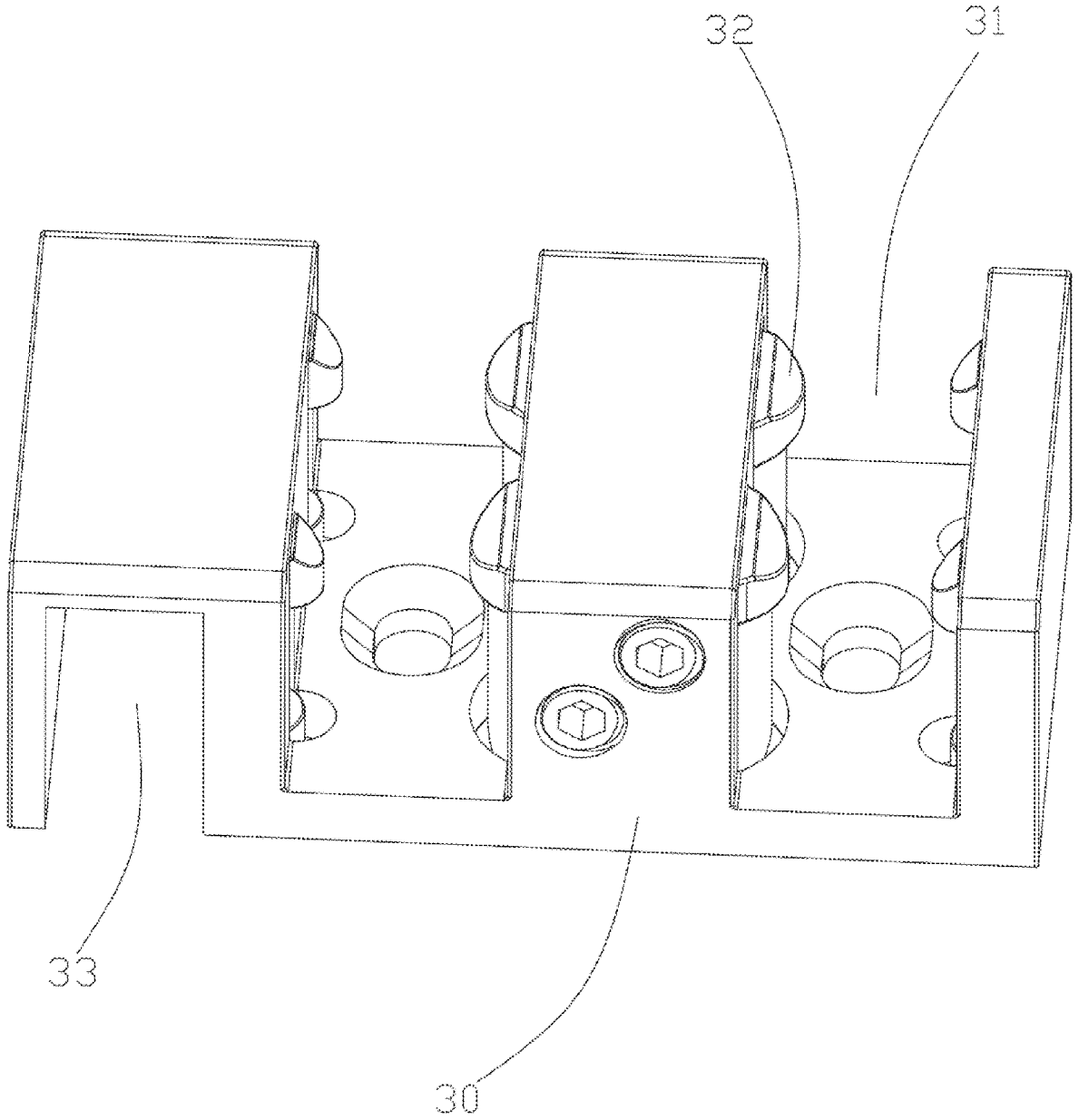
FIG. 8 is a schematic structural diagram of a lower fixed seat shown in FIG. 2.

As shown in FIGS. 2 and 8, the frameless and hidden pulley bathroom door 100 further includes a lower fixed seat 30 and a water blocking member 40 that are provided at a bottom of the sliding door 20. The lower fixed seat 30 is configured to provide a fulcrum for the bottom of the fan body 21, in order to enhance a stability of the sliding of the fan body 21 and prevent it from shaking. The lower fixed seat 30 is provided with a sliding groove 31 corresponding to the fan body 21. In an implementation mode, in order to avoid collision between the fan body 21 and the sliding groove 31, a limiting element 32 is further provided inside the sliding groove 31, and in an implementation mode, the limiting element 32 is made of elastic material. To further reduce friction, the limiting element 32 can be rotatably connected with the lower fixed seat 30. In an implementation mode, a distance between the limiting elements 32 inside the sliding groove 31 can be adjusted according to a thickness of the fan body 21. An adjusting screw (not shown in the drawing) is provided on the lower fixed seat 30 to adjust the distance between the limiting elements 32. The water blocking member 40 is installed on one side of the fan body 21 so as to prevent water from spreading from the bottom of the fan body 21. The water blocking member 40 is provided on a ground fan at a bottom of the sliding door 20 through a pressure block 41, and there is also a clamp slot 33 corresponding to the water blocking member 40 on the lower fixed seat 30.

In this embodiment, the fan body 21 is a glass plate. In other embodiments, the fan body 21 can also be a board made of materials such as stone, wood, composite materials, etc.

Figure 9:
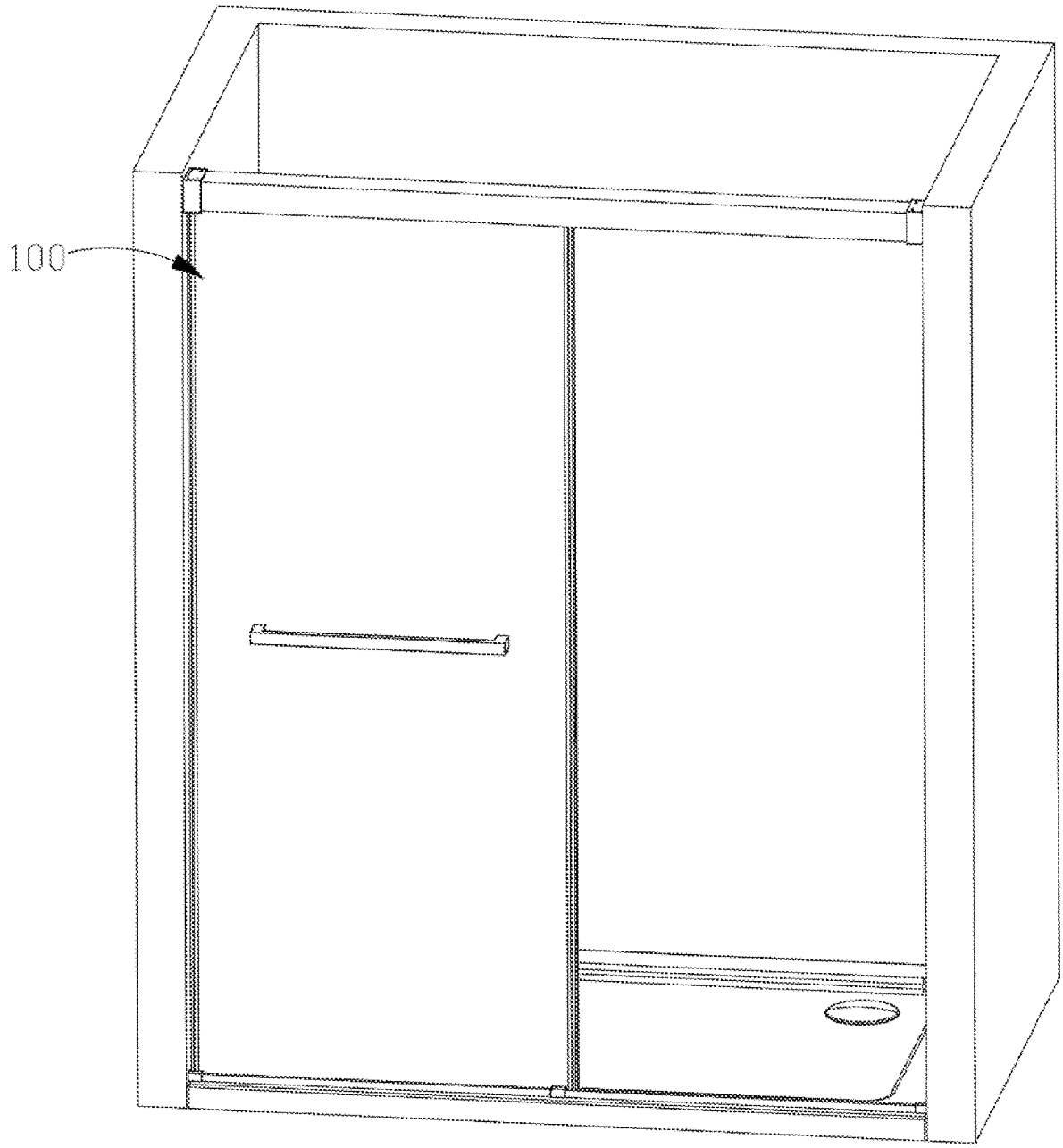
FIG. 9 is an application example diagram of the frameless and hidden pulley bathroom door of the present application.

Please refer to FIG. 9, which is an application example of the frameless and hidden pulley bathroom door 100 of the present application. The frameless and hidden pulley bathroom door 100 is installed at a bathroom door, which changes a traditional defect of having frames on left and right of the bathroom door and exposed the pulleys 22. It adopts a unique hidden design of the pulley 22 and omits the side frame on the door opening, thereby improving the appearance texture and rendering it simpler and more beautiful. At the same time, by providing with the waterproof strips 24 and water blocking member 40, the shower waterproof effect is increased, thereby saving more space. Besides that, the sliding door 20 is more convenient to open and close, which reflects a highly humanized design. A borderless design allows for easy access and cleaning of hygiene blind spots.

Embodiment 2

Figure 10:
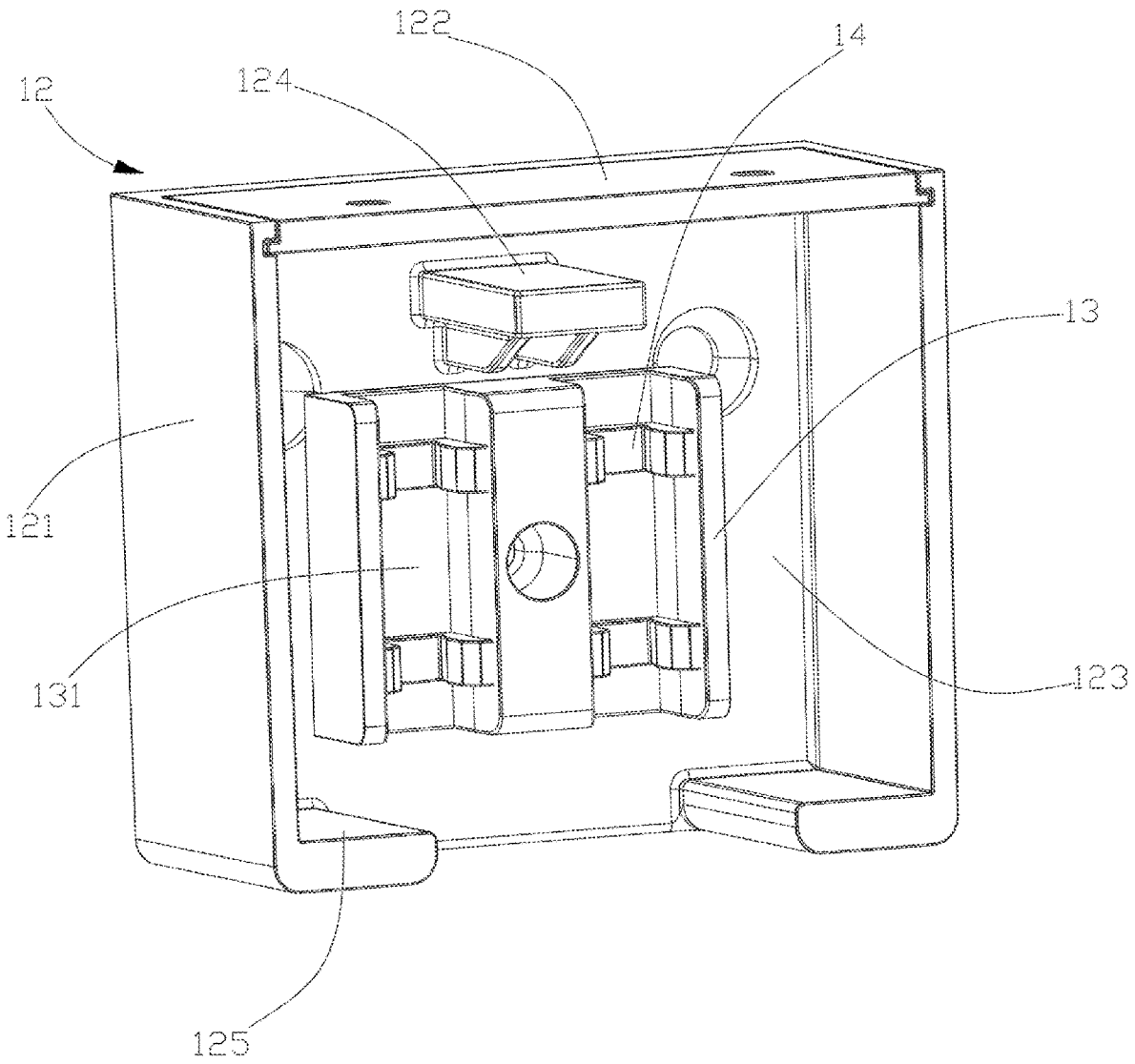
FIG. 10 is another schematic structural diagram of the fixed seat, the guide clip, and the buffering member in the frameless and hidden pulley bathroom door of the present application.

Please refer to FIG. 10, which shows a second embodiment of the present application. The frameless and hidden pulley bathroom door 100 in this embodiment is similar to the first embodiment in structural. The difference is that in this embodiment, the structure of the fixed seat 12, the guide clip 13, and the buffering member 14 have been adjusted. A part of the buffering member 14 that is extended into the guide groove 131 is a U-shape or has a rectangle opening, which can better wrap around the fan body 21 and provide protection for the fan body 21.

Finally, it should be noted that the above description is only preferred examples of the present application and is not intended to limit the present application. Although the present application has been described in detail with reference to the aforementioned embodiments, it is still possible for those skilled in the art to modify the technical solutions described in the aforementioned embodiments or replace some of the technical features with equivalent modifications. Any modifications, equivalent substitutions, improvements, etc. made within the spirit and principles of the present application shall be included in the protection scope of the present application.

What is claimed is:

1. A pulley bathroom door, comprising: a fixed rail and a sliding door installed at a bottom of the fixed rail, wherein the sliding door comprises a fan body and a pulley rotatably connected to the fan body, the pulley is installed on one side of a top of the fan body, the fixed rail comprises a rail body, the rail body comprises a bottom plate, side plates installed on two sides of the bottom plate, and guide rails installed on the side plates, the bottom plate and two side plates form a chamber with an opening that accommodates the fan body and the pulley, the guide rail is installed on inner sides of the side plates, and the pulley cooperates with the guide rail, wherein the sliding door further comprises an installation seat configured to install the pulley, the installation seat comprises a fixed disk and an eccentric seat, the fixed disk and the pulley are respectively provided on opposite sides of the fan body, the eccentric seat is fixedly provided on one side of the fixed disk near the pulley, and the eccentric seat is eccentrically provided with the fixed disk, the pulley comprises a wheel body and a rotation shaft, the rotation shaft is fixedly connected to the eccentric seat, and the wheel body is rotatably connected to the rotation shaft.

2. The hidden pulley bathroom door according to claim 1, wherein the installation seat further comprises a shaft sleeve that is arranged on an outer surface of the eccentric seat.

3. The pulley bathroom door according to claim 1, wherein the fixed disk is equipped with an adjustment groove configured to adjust an angle of the eccentric seat.

4. The pulley bathroom door according to claim 1, wherein the installation seat further comprises a first protective cover and a second protective cover, the first protective cover comprises a first cover body and a first extension rod, the first cover body is covered with the fixed disk, one end of the first extension rod is connected to the first cover body, and the other end thereof is extended over a top of the fan body and towards the pulley, the second protective cover comprises a second cover body and a second extension rod, the second cover body is provided between the fan body and the wheel body, and the second cover body is equipped with a through hole configured for the rotation shaft to pass through;

one end of the second extension rod is connected to the second cover body, and the other end thereof is extended over the top of the fan body and towards the first cover body.

5. The pulley bathroom door according to claim 1, wherein the fixed rail further comprises fixed seats installed at two ends of the rail body, each of the fixed seats comprises a seat body and a cover plate detachably connected to the seat body, the seat body is equipped with a slot.

6. The pulley bathroom door according to claim 5, wherein the fixed rail further comprises a guide clip embedded in the seat body, and the guide clip is equipped with a guide groove.

7. The pulley bathroom door according to claim 6, wherein the fixed rail further comprises a buffering member that is installed in the guide groove.

8. The pulley bathroom door according to claim 1, wherein the sliding door further comprises waterproof strips, which are arranged on opposite sides of the fan body.

9. The pulley bathroom door according to claim 1, further comprising a lower fixed seat and a water blocking member that are arranged at a bottom of the sliding door, wherein the lower fixed seat is equipped with a sliding groove, and the water blocking member is arranged on one side of the fan body so as to prevent water from spreading from a bottom of the fan body.

* * * * *